US006747202B2

(12) United States Patent
Kuroki

(10) Patent No.: US 6,747,202 B2
(45) Date of Patent: Jun. 8, 2004

(54) SOUND GENERATING SYSTEM PRODUCING SOUND FROM VIBRATIONS IN MUSICAL INSTRUMENT THROUGH NATURAL MICROPHONE SIMULATION

(75) Inventor: Ryuichiro Kuroki, Shizuoka (JP)

(73) Assignee: Yamaha Corporation, Shizuoka-Ken (JP)

( * ) Notice: Subject to any disclaimer, the term of this patent is extended or adjusted under 35 U.S.C. 154(b) by 0 days.

(21) Appl. No.: 10/180,057

(22) Filed: Jun. 27, 2002

(65) Prior Publication Data

US 2003/0000370 A1 Jan. 2, 2003

(30) Foreign Application Priority Data

Jun. 29, 2001 (JP) ..... 2001-199840

(51) Int. Cl.[7] ..... G10H 1/02
(52) U.S. Cl. ..... 84/737; 84/726
(58) Field of Search ..... 84/737, 726, 630, 84/707, 662; 361/61, 63

(56) References Cited

U.S. PATENT DOCUMENTS 5,189,241 A * 2/1993 Nakamura ..... 84/728
5,491,754 A * 2/1996 Jot et al. ..... 381/63
6,122,444 A * 9/2000 Shen et al. ..... 710/52

* cited by examiner

*Primary Examiner*—Rina Duda
*Assistant Examiner*—David Warren
(74) *Attorney, Agent, or Firm*—Dickstein, Shapiro, Morin & Oshinsky, LLP

(57) ABSTRACT

A sound generating system produces tones from an audio signal as if tones originally produced from an acoustic guitar are converted to an electric signal through a microphone; the electric signal is produced from vibrations of the strings through a pickup unit, and is converted to digital signals; a digital signal processor simulates reverberation generated through a resonator of the guitar and direct tones directly produced from the strings through plural sorts of digital data processing; the signal component representative of the reverberation is added to the signal component representative of the direct tones for producing the audio signal; the digital signal processor simulates the direct tones through the function of an all-pass filter so that the reproduced sound has the timbre approximate to the timbre of the original tones.

20 Claims, 3 Drawing Sheets

SOUND GENERATING SYSTEM PRODUCING SOUND FROM VIBRATIONS IN MUSICAL INSTRUMENT THROUGH NATURAL MICROPHONE SIMULATION

FIELD OF THE INVENTION

This invention relates to a sound generating system and, more particularly, to a sound generating system for producing sound from vibrations in a musical instrument through a natural microphone simulation.

DESCRIPTION OF THE RELATED ART

A stringed instrument such as, for example an acoustic guitar is used for ensemble as well as solo. The solo or ensemble may be recorded through a microphone. While the acoustic guitar is being ensembled with other musical instruments, the acoustic guitar sound is gathered through the microphone together with the other sorts of sound, and the acoustic guitar sound and the other sorts of sound are converted to an electric signal, and are mixedly stored in a suitable recording medium. It is impossible to record only the acoustic guitar sound through the microphone during the ensemble. If the guitar sound is to be selectively recorded during the ensemble, the vibrations of strings are directly converted through a pickup unit, which is attached to the acoustic guitar to an electric signal. A piezoelectric converting element is preferable for the direct conversion from the mechanical vibrations to electric energy, because the electric signal from the piezoelectric pickup unit is easy processed for the volume control and feedback control. The electric signal is equalized and amplified through a suitable amplifier, and is supplied to a speaker system. The speaker system converts the electric signal to reproduced guitar sound.

Although the electric signal is directly converted from the vibrations of strings, the listener feels the reproduced guitar sound different from the acoustic guitar sound. The listener expresses the reproduced guitar sound as "not so rich as the acoustic guitar sound". This is because of the fact that the electric signal merely represents the vibrations of the strings. In other words, the electric signal does not contain signal components representative of the reverberation.

It is proposed to process the electric signal for making the reproduced guitar sound approximate to the acoustic guitar sound. The prior art signal processing system simulates the reverberation in the resonator of the acoustic guitar as well as the sound directly produced from the vibrations of the plucked string. The sound directly produced from the vibrations of the plucked string is hereinbelow referred to as "direct sound". The prior art signal processing system includes a signal processing unit assigned to the direct sound. The signal processing unit has a delay circuit, and produces an electric signal representative of the direct sound through the delay circuit.

Although the prior art signal processing system produces an audio signal representative of a reproduced sound with the reverberation, sharp dips periodically take place in the frequency characteristics of the audio signal so that a certain frequency band is unnaturally emphasized. The certain frequency band influences the timbre of the reproduced sound, and the listener feels the reproduced sound unnatural.

SUMMARY OF THE INVENTION

It is an important object of the present invention to provide a sound generating system, which produces sound approximate to acoustic sound of a predetermined acoustic musical instrument through a natural microphone simulation regardless of another sort of sound concurrently produced.

In accordance with one aspect of the present invention, there is provided a sound generating system associated with a musical instrument for producing a sound from vibrations generated in the musical instrument, and the sound generating system comprises a pickup unit attached to the musical instrument for converting the vibrations to a first electric signal, a signal receiving section connected to the pickup unit and outputting a second electric signal corresponding to the first electric signal, a data processing section connected to the signal receiving section, simulating a direct sound produced from the vibrations and at least a reverberation of an original sound directly generated from the musical instrument on the basis of the second electric signal and adding a signal component representative of the simulated reverberation to a signal component representative of the simulated direct sound for producing a third electric signal and a sound generating section connected to the data processing section and producing the sound approximate to the original sound from the third electric signal.

BRIEF DESCRIPTION OF THE DRAWINGS

The features and advantages of the signal processing system and the sound generating system will be more clearly understood from the following description taken in conjunction with the accompanying drawings, in which.

DESCRIPTION OF THE PREFERRED EMBODIMENT

Figure 1:
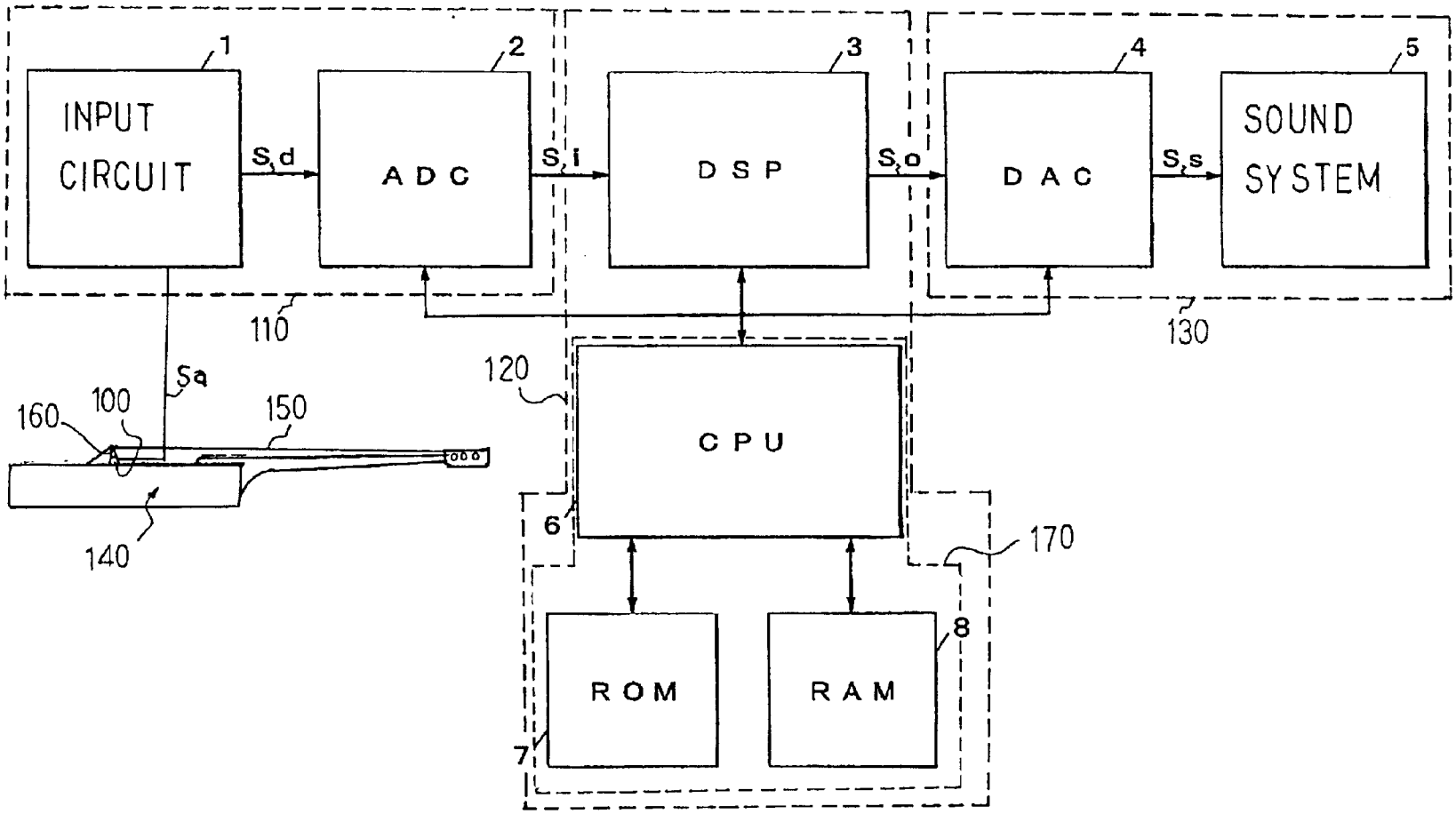
FIG. 1 is a block diagram showing the system configuration of a sound generating system according to the present invention.

Referring to FIG. 1 of the drawings, a sound generating system embodying the present invention largely comprises a pickup unit 100, a signal receiving section 110, a signal processing section 120 and a sound generating section 130. The pickup unit 100 is attached to an acoustic guitar 140, and converts vibrations of strings 150 to an electric signal Sa. In this instance, the pickup unit 100 is of the type converting the vibrations to the electric signal Sa by means of a piezoelectric element, and is embedded in a bridge 160. While the strings 150 are vibrating, the strings 150 repeatedly exert stress on the bridge 160, and the bridge 160 transmits the stress to the piezoelectric element 100. The piezoelectric element 100 is sensitive to the stress, and converts the stress to electric charge. Thus, the pickup unit 100 directly produces the electric signal Sa from the vibrations of the strings 150 so that other sorts of sound are never mixed into the electric signal Sa.

The electric signal Sa is supplied from the pickup unit 100 to the signal receiving section 110. The signal receiving section 110 preliminarily processes the electric signal Sa for the signal processing section 120, and supplies an electric signal Si to the signal processing section 120.

The signal processing section 120 achieves two major jobs. The first job is to simulate at least reverberation generated by the resonator of the acoustic guitar 140, and the second job is to simulate the direct sound produced from the vibratory strings 150. The signal processing section 120 may further simulate reflection-tones in a certain environment such as, for example, a hall. In detail, the signal processing section 120 produces reverberatory components representative of the reverberation from the electric signal Si, and adds delay components to the electric signal Si without changing the frequency characteristics of the electric signal Si for producing a composite electric signal. The composite electric signal is representative of the direct sound of the acoustic guitar. The signal processing section 120 adds the reverberatory components to the composite electric signal so as to produce a quasi-acoustic signal So. The quasi-acoustic signal So is representative of sound approximate to the guitar sound.

The quasi-acoustic signal So is supplied from the signal processing section 120 to the sound generating section 130. The sound generating section 130 produces an audio signal from the quasi-acoustic signal So, and converts the audio signal to quasi-guitar sound. Thus, the sound generating system according to the present invention simulates both of the reverberation and the direct sound so that the quasi-guitar sound is more analogous to the acoustic guitar sound than the sounds produced by the prior art sound generating system. Especially, the signal processing section 120 maintains the frequency characteristics of the composite electric signal similar to the electric signal Si so that the timbre of the quasi-guitar sound is approximate to that of the acoustic guitar. The audience feels the attack of the tones natural.

In this instance, the signal processing section 120 carries out a digital signal processing on the electric signal Si. For this reason, the electric signal is converted between the digital form and analog form on both sides of the signal processing section 120.

The signal receiving section 110, signal processing section 120 and sound generating section 130 are hereinbelow described in detail. The signal receiving section 110 includes an input circuit 1 and an analog-to-digital converter 2, which is abbreviated as "ADC" in the drawings. The input circuit 1 receives the electric signal Sa, and transfers the electric signal Sa to the analog-to-digital converter 2. The potential level is sampled in response to a clock signal at short intervals, and is converted to a corresponding binary value. Thus, the electric signal Sa is converted to a series of binary values, and the digital signal Si is supplied from the analog-to-digital converter 2 to the signal processing section 120.

The sound generating section 130 includes a digital-to-analog converter 4 and a sound system 5. The digital-to-analog converter 4 is abbreviated as "DAC" in the drawings. As described hereinbefore, the signal processing section 120 simulates the reverberation and the direct sound, and produces the quasi-acoustic signal So in the form of digital codes. The signal processing section 120 supplies the digital quasi-acoustic signal So to the digital-to-analog converter 4, and the digital-to-analog converter 4 produces the audio signal Ss from the digital quasi-acoustic signal So through the digital-to-analog conversion. The sound system 5 includes suitable amplifiers and speakers. The audio signal Ss is amplified and equalized by the amplifiers, and, thereafter, the quasi-guitar sound is produced from the audio signal Ss.

In the case where the signal processing section 120 simulates the reflection-tones, it is desirable that the signal processing section 120 separates the digital quasi-acoustic signal So into a left-channel signal and a right-channel signal for stereophonic sound.

The signal processing section 120 includes a digital signal processor 3 and a data processing unit 170. The digital signal processor 3 is abbreviated as "DSP" in the drawings. The data processing unit 170 controls the other system components, and includes a central processing unit, i.e., CPU 6, a program memory 7 and a working memory 8. In this instance, the program memory 7 and working memory 8 are implemented by a read only memory, i.e., ROM and a random access memory, i.e., RAM. Parameters and coefficients are also stored in the read only memory.

Figure 2:
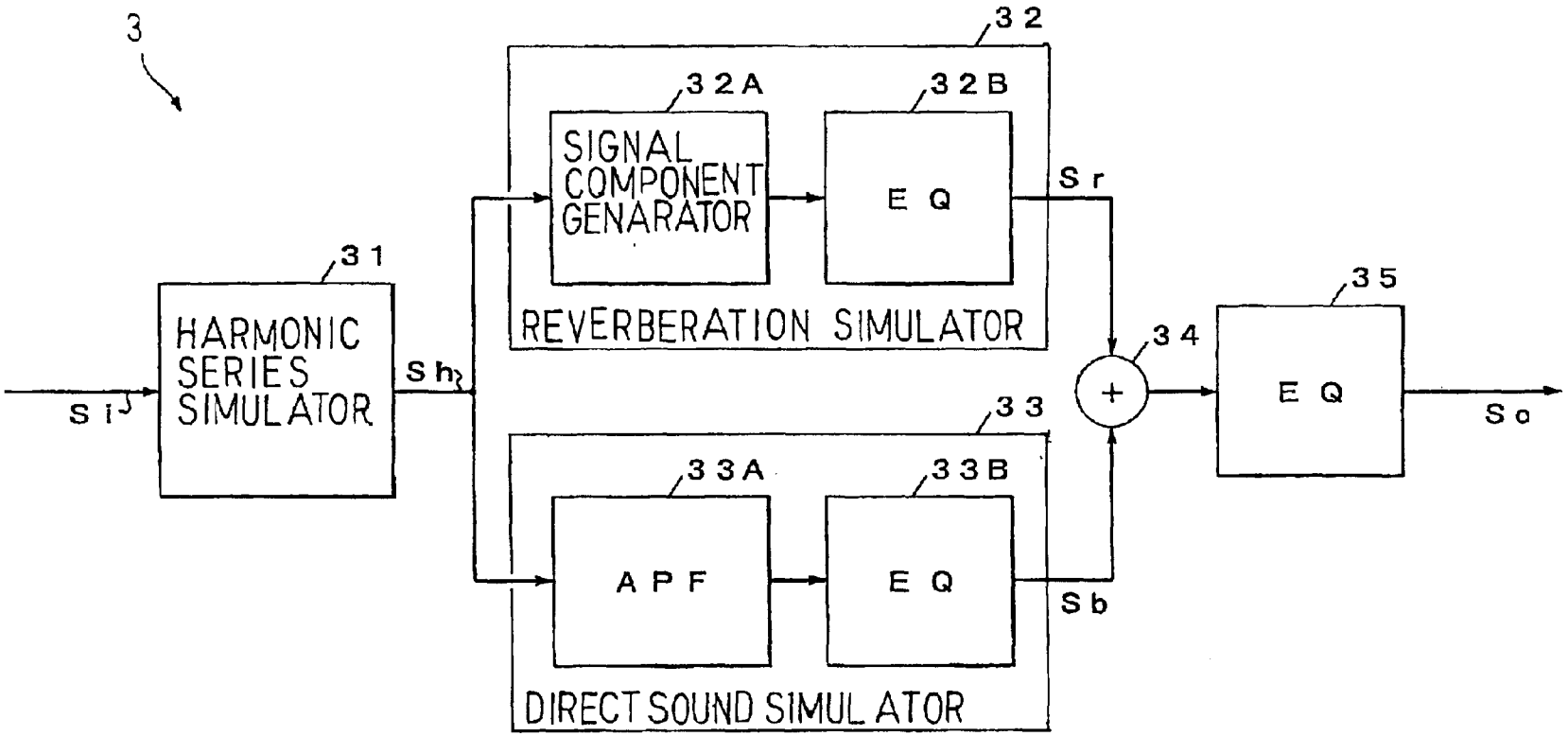
FIG. 2 is a block diagram showing functions realized by a digital signal processor incorporated in the sound generating system.

The digital signal processor 3 achieves several jobs, and realizes several functions corresponding to a harmonic series simulator 31, a reverberation simulator 32, a direct sound simulator 33, a mixer 34 and an equalizer 35 as shown in FIG. 2. These functions or the component sections 31, 32, 33, 34 and 35 are realized through several sorts of digital signal processing.

The digital signal processor 3 firstly simulates a harmonic series to be added to the tone represented by the electric signal Sa. For this reason, the digital signal Si is firstly supplied from the analog-to-digital converter 2 to the digital harmonic series simulator 31. Although the piezoelectric elements 100 convert the strength of plucking/picking on the strings 150 to the amplitude of the electric signals Sa, the audience recognizes the strength of plucking/picking as variation of harmonic series under the condition that the amplitude in the attack exceeds a certain level. The harmonic series simulator 31 aims at imparting signal components representative of the harmonic series varied depending upon the amplitude of the electric signals S to the digital signal Si. In order to vary the harmonic series, the digital signal is processed as if the electric signal Sa passes through a circuit which softly clips the electric signal Sa for increasing the harmonics together with the amplitude of the electric signal Sa. When the electric signal Sa is output from the circuit, the distortion is increased in the electric signal Sa depending upon the amplitude. The function of the circuit is realized by the harmonic series simulator 31. The digital signal processor 3 converts the input digital signal Si to output digital signal Sh by using an input-and-output conversion table or through calculations on certain arithmetic equations. An example of the conversion is disclosed in Japanese Patent Application laid-open No. 5-127672. Upon completion of the digital signal processing, the digital signal Sh contains the signal component representative of the harmonic series. By virtue of the harmonic series represented by the signal component, the audience feels the attack of the quasi-guitar tones natural.

Subsequently, the digital signal Sh is subjected to two sorts of data processing as if the digital signal Sh is supplied in parallel to the reverberation simulator 32 and the direct sound simulator 33.

The reverberation simulator 32 adds signal components representative of the reverberation to the digital signal Sh, and equalizes the resultant digital signal. Namely, the reverberation simulator 32 has a signal component generator 32A and an equalizer 32B. The equalizer 32B is abbreviated as "EQ" in the drawings. The signal component generator 32A stands for the simulation of the reverberation. The digital signal processor 3 simulates the reverberation generated through the resonator of the acoustic guitar 140 and the reflection-tones through the digital signal processing, and adds signal components representative of the reverberation and reflection-tones to the digital signal Sh. The reflection-tones are like tones recorded in a room through a microphone spaced from an acoustic guitar. The digital signal processing for the signal components is equivalent to the function achieved through a comb-type filter circuit. The function for the reverberation and the circuit configuration of the comb-type filter circuit are well known to persons skilled in the art, and no further description is incorporated hereinbelow. When the reverberation is simulated, the delay time in the comb-like filter circuit is to be short, i.e., not longer than 20 milliseconds so that the reverberation is as rich as the reverberation generated through the resonator of the acoustic guitar.

The reverberation simulator 32 corrects the digital signals through the digital signal processing corresponding to the function of the equalizer 32B so as to make the timbre of the quasi-guitar sound analogous to the timbre of the acoustic guitar sound. The reverberation simulator 32 eliminates a signal component representative of high-frequency components from the digital signal. Although the short reverberation rends to vary the timbre of the quasi-guitar sound, the reverberation 32 corrects the signal component for preventing the quasi-guitar sound from change of timbre. As a result, when the digital signal is converted through the audio signal to the quasi-guitar sound, the audience feels the quasi-guitar sound as if they hear a sound generated in a woody instrument.

The digital signal processing for the direct sound simulation is corresponding to the function of an all-pass filter 33A and the function of an equalizer 33B. The all-pass filter 33A and the equalizer 33B are abbreviated as "APF" and "EQ", respectively. The digital signal processor 3 simulates the direct sound radiated from the strings 150 through the function of the all-pass filter 33A. Although the digital signal processor 3 adds a delay component to the digital signal, the timbre of the quasi-guitar sound still has the timbre analogous to the acoustic guitar. The digital signal processor 3 makes the attack of the quasi-guitar sound analogous to that of the acoustic guitar sound.

As described hereinbefore, guitar sound reproduced from an electric signal converted through a microphone is different from guitar sound reproduced from an electric signal converted through a piezoelectric element in the harmonic series of the attack portion. The difference results in that the former is richer than the latter. The digital signal processor 3 imparts a signal component supplementing the difference to the digital signal Sh through the function of the all-pass filter 33A.

Figure 3:
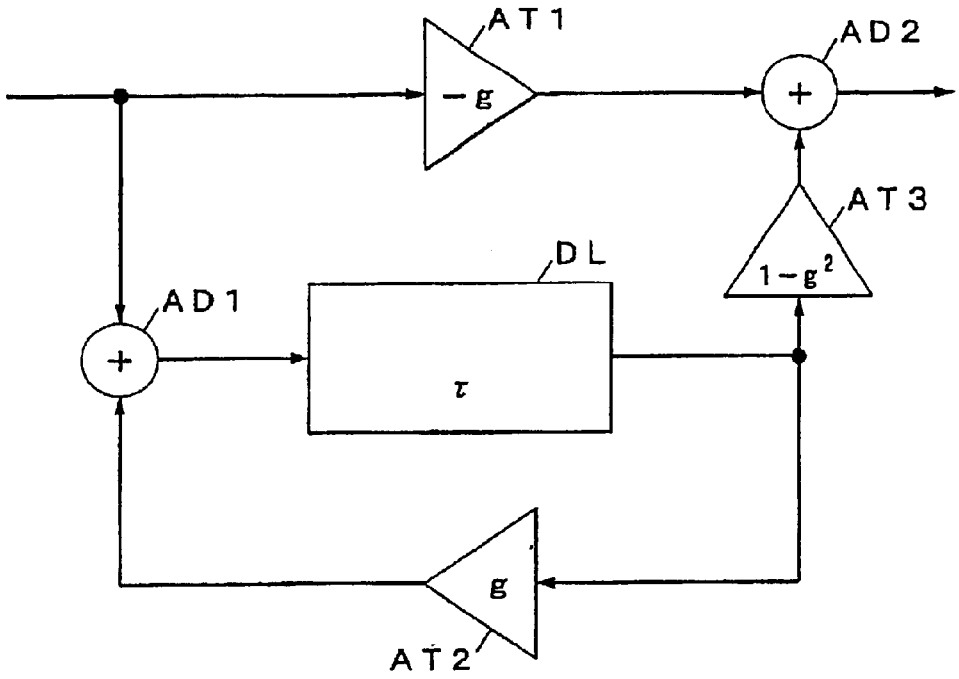
FIG. 3 is a block diagram showing the functions of an all-pass filter realized by the digital signal processor.
Figure 4:
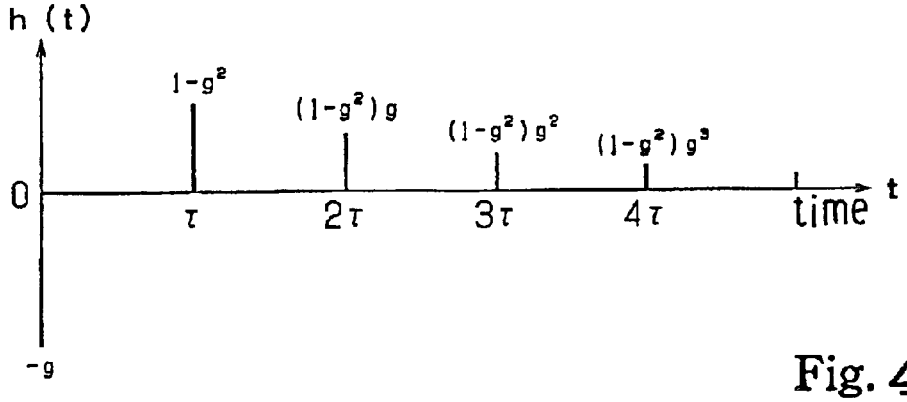
FIG. 4 is a graph showing time-response characteristics of the all-pass filter.

The all-pass filter 33A is equivalent to the combination of a loop of a delay circuit DL, multipliers AT1/AT2/AT3 and adders AD1/AD2 as shown in FIG. 3. The delay circuit DL, multipliers AT1/AT2/AT3 and adders AD1/AD2 as a whole constitute a Schroeder all-pass filter. The delay circuit DL introduces delay time r into the signal propagation therethrough, and the impulse response h(t) is expressed by equation 1, and the time-response characteristics are shown in FIG. 4.

$$h(t)=-g\delta(t)+(1-g^2)[\delta(t-\tau)+g\delta(t-2\tau)+g^2\delta(t-3\tau)+\ldots] \quad \text{equation 1}$$

where g is coefficients in the multipliers.

Figure 5:
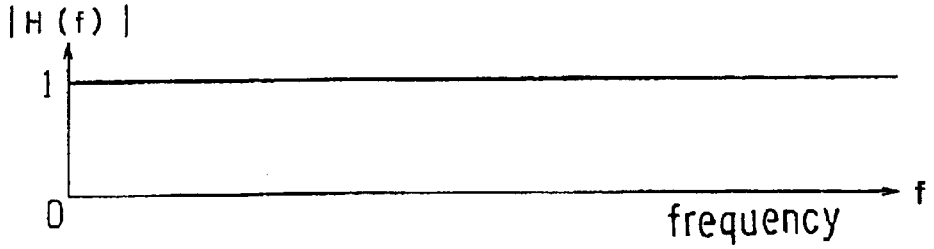
FIG. 5 is a graph showing frequency characteristics of the all-pass filter.

The transfer function is expressed by equation 2, and is absolutized as expressed by equation 3. The frequency characteristics of the all-pass filter 33A are shown in FIG. 5.

$$H(\omega)=-g+(1-g^2)\exp(-j\omega\tau)/[1-g\exp(-j\omega\tau)] \quad \text{Equation 2}$$

$$|H(\omega)|=1 \quad \text{Equation 3}$$

The delay time X is to be shorter than the delay time introduced by the signal component generator 32A, and is not longer than 10 milliseconds. It is preferable that the coefficient g of the feedback multiplier AT2 is fallen within the range from 0.5 to 0.8. However, the all-pass filter 33A is to be prevented from oscillation and drastic decay.

The digital signal processor 3 processes the digital signal Sh through the function of the all-pass filter 33A, in which the delay time r is short so that the signal component representative of short delay is added to the digital signal without varying the frequency characteristics. This results in that the quasi-guitar tones have the attacks analogous to those of the acoustic guitar tones.

The digital signal, to which the signal component representative of the delay has been already supplemented, is subjected to the equalization for preventing the quasi-guitar sound from undesirable change in timbre. Namely, the digital signal is supplied from the all-pass filter 33A to the equalizer 33*b*. The digital signal Sb thus equalized is mixed with the digital signal Sr as if analog signals corresponding to the digital signals Sr/Sb are supplied to the mixer 34. The mixing ratio has been given to the digital signal processor 3. Finally, the digital signal processor 3 corrects the signal components representative of the frequency spectrum for making the quasi-guitar sound approximate to the acoustic guitar sound. The function of the digital signal processor 3 is same as the equalizer 35. Thus, the digital quasi-acoustic signal So is output from the equalizer 35, and is supplied to the sound generating section 130.

As will be appreciated from the foregoing description, the sound generating system according to the present invention processes the electric signal representative of the vibrations generated in a musical instrument so as to add the signal components representative of the reverberation/reflection-tones and the signal components representative of natural attack of the musical instrument to the received electric signal. When sound is reproduced from the electric signal, the audience feels the sound approximate to the original sound generated from the musical instrument. In the sound generating system, the digital signal processor 3 processes the electric signal through the function of the reverberation simulator 32 and the function of the direct sound simulator 33 in parallel. The digital signal processor 3 simulates the reverberation generated through the resonator of the musical instrument 140 and the reflection-tones in a certain room through the function of the reverberation simulator 32, and produces the signal components representative of the reverberation and the reflection-tones. The digital signal processor 3 further simulates the attack of the original tones, and produces the signal components representative of the attack. The digital signal processor 3 adds both signal components to the electric signal, and the sound is produced from the electric signal. This results in the sound approximate to the original sound. Especially, the digital signal processor 3 introduces the signal components representative of the short delay into the electric signal through the function of the all-pass filter so that the frequency spectrum is not widely varied. Thus, the sound generating system produces the sound approximate to the original sound as if the original sound is converted to the electric signal through a microphone. Moreover, the digital signal processor adds the signal component representative of a harmonic series to the electric signal through the function of the harmonic series simulator before the digital processing through the functions of the reverberation/direct sound simulators. The signal components representative of the harmonic series further makes the attack of the sound natural.

An acoustic guitar generates the acoustic tones which contain not only the harmonics but also non-harmonic components. The non-harmonic components feature the guitar sound as well as the harmonics do. However, when the vibrations of strings are converted through the piezoelectric element to the analog signal Sa, the electric signal Sa does not contain a signal component representative of the non-harmonic components, and has a frequency spectrum different from that of the acoustic guitar tones. Audience feels the sound produced directly from the electric signal "inorganic". The spectrum of the acoustic guitar sound is restored through the all-pass filter 33A. In other words, the when the low-frequency component is emphasized, the quasi-guitar tones become close to the sound resonated in woody resonator. On the other hand, when the high-frequency components are emphasized, the audience feels the quasi-guitar sound metallic. Thus, the sound generating system according to the present invention modifies the spectrum through the digital signal processing so as to make the quasi-guitar tones close to the acoustic guitar tones.

Although the particular embodiment of the present invention has been shown and described, it will be apparent to those skilled in the art that various changes and modifications may be made without departing from the spirit and scope of the present invention.

For example, the pickup unit 100 may be implemented by another sort of vibration detecting elements such as, for example, photo-sensors or magnetic sensors. Photo-couplers may be used as the photo-sensors, and electromagnetic pickups are examples of the magnetic sensors.

The sound generating system may be associated with another sort of stringed instrument, a percussion instrument and a keyboard musical instrument.

What is claimed is:

1. A sound generating system associated with a musical instrument, the musical instrument generating an original sound and vibrations, the sound generating system comprising:

a pickup unit attached to said musical instrument for converting said vibrations to a first electric signal;

a signal receiving section connected to said pickup unit, the signal receiving section receiving the first electric signal and outputting a second electric signal in response to said first electric signal;

a data processing section connected to said signal receiving section, the data processing section operable to:

(a) receive said second electric signal, (b) modify said second electric signal to simulate a direct sound generated by said vibrations, thus producing a simulated direct sound signal, (c) modify said second electric signal to simulate reverberations generated by said musical instrument, thus producing a simulated reverberatory sound signal, and (d) add said simulated direct sound signal to said simulated reverbatory sound signal to produce a third electric signal; and a sound generating section connected to said data processing section, the sound generating section receiving said third electric signal and producing a sound approximate to said original sound.

2. The sound generating system as set forth in claim 1, in which said signal receiving section has an analog-to-digital converter for producing said second electric signal from said first electric signal, said sound generating section has a digital-to-analog converter for converting said third electric signal from a digital form to an analog form and said data processing section is a digital signal processor for carrying out said simulations.

3. The sound generating system as set forth in claim 2, in which said simulated direct sound signal is produced using an all-pass filter.

4. The sound generating system as set forth in claim 3, in which said digital signal processor introduces a delay into said second electric signal using said all-pass filter for producing said simulated direct sound signal.

5. The sound generating system as set forth in claim 3, in which said all-pass filter is a Schroeder all-pass filter.

6. The sound generating system as set forth in claim 5, in which said Schroeder all-pass filter includes a signal input node supplied with said second electric signal, a first multiplier having an input node connected to said signal input node, a first adder having a first input node connected to said signal input node, a delay circuit having an input node connected to an output node of said first adder, a second multiplier having an input node connected to an output node of said delay circuit, a third multiplier having an input node connected to said output node of said delay circuit and an output node connected to a second input node of said first adder and a second adder having a first input node connected to an output node of said first multiplier and a second input node connected to an output node of said second multiplier and an output node for outputting said simulated direct sound signal.

7. The sound generating system as set forth in claim 6, in which said delay circuit introduces a delay time shorter than a delay time introduced by said modification of said second electric signal to simulate reverberations.

8. The sound generating system as set forth in claim 7, in which said delay time introduced by said delay circuit is equal to or less than 10 millisecond.

9. The sound generating system as set forth in claim 6, in which said third multiplier multiplies the value at said input node thereof by a coefficient ranging from 0.5 to 0.8.

10. The sound generating system as set forth in claim 2, in which said simulated direct sound signal and said simulated reverbatory sound signal are respectively achieved using an all-pass filter and a comb-type filter.

11. The sound generating system as set forth in claim 10, in which said all-pass filter is a Schroeder all-pass filter.

12. The sound generating system as set forth in claim 11, in which said Schroeder all-pass filter includes a signal input node supplied with said second electric signal, a first multiplier having an input node connected to said signal input node, a first adder having a first input node connected to said signal input node, a delay circuit having an input node connected to an output node of said first adder, a second multiplier having an input node connected to an output node of said delay circuit, a third multiplier having an input node connected to said output node of said delay circuit and an output node connected to a second input node of said first adder and a second adder having a first input node connected to an output node of said first multiplier and a second input node connected to an output node of said second multiplier and an output node for outputting said simulated direct sound signal.

13. The sound generating system as set forth in claim 12, in which said delay circuit introduces a delay time shorter than a delay time introduced by said modification of said second electric signal to simulate reverberations.

14. A sound generating system associated with a musical instrument, the musical instrument generating an original sound and vibrations, the sound generating system comprising:

a pickup unit attached to said musical instrument for converting said vibrations to a first electric signal;

a signal receiving section connected to said pickup unit, the signal receiving section receiving the first electric signal and outputting a second electric signal in response to said first electric signal;

a data processing section connected to said signal receiving section, the data processing section operable to:

(a) receive said second electric signal, (b) modify said second electric signal to simulate a harmonic series corresponding to an attack of a direct sound generated by said vibrations thus producing a third electric signal having a signal component representative of said harmonic series (c) modify said third electric signal to simulate a direct sound generated by said vibrations, thus producing a simulated direct sound signal, (d) modify said third electric signal to simulate reverberations generated by said musical instrument, thus producing a simulated reverberatory sound signal, and (e) add said simulated direct sound signal to said simulated reverbatory sound signal to produce a fourth electric signal; and a sound generating section connected to said data processing section, the sound generating section receiving said fourth electric signal and producing a sound approximate to said original sound.

15. The sound generating system as set forth in claim 14, in which said signal receiving section, has an analog-to-digital converter for producing said second electric signal from said first electric signal, said sound generating section has a digital-to-analog converter for converting said fourth electric signal from a digital form to an analog form and said data processing section is a digital signal processor for carrying out said simulations.

16. The sound generating system as set forth in claim 15, in which said simulated direct sound signal is produced using an all-pass filter.

17. The sound generating system as set forth in claim 16, in which said digital signal processor introduces a delay into said third electric signal using said all-pass filter for producing said simulated direct sound signal.

18. The sound generating system as set forth in claim 16, in which said all-pass filter is a Schroeder all-pass filter.

19. The sound generating system as set forth in claim 18, in which said Schroeder all-pass filter includes a signal input node supplied with said third electric signal, a first multiplier having an input node connected to said signal input node, a first adder having a first input node connected to said signal input node, a delay circuit having an input node connected to an output node of said first adder, a second multiplier having an input node connected to an output node of said delay circuit, a third multiplier having an input node connected to said output node of said delay circuit and an output node connected to a second input node of said first adder and a second adder having a first input node connected to an output node of said first multiplier and a second input node connected to an output node of said second multiplier and an output node for outputting said simulated direct sound signal.

20. The sound generating system as set forth in claim 19, in which said delay circuit introduces a delay time shorter than a delay time introduced by said modification of said third electric signal to simulate reverberations.

* * * * *